US005351421A

United States Patent [19]

Miers

[11] Patent Number: 5,351,421

[45] Date of Patent: Oct. 4, 1994

[54] SPORTS SHOE SOLE

[76] Inventor: David J. Miers, 17 Tennyson Court, Templestowe, Victoria, 3106, Australia

[21] Appl. No.: 923,879

[22] PCT Filed: Feb. 15, 1991

[86] PCT No.: PCT/AU91/00056

§ 371 Date: Aug. 27, 1992

§ 102(e) Date: Aug. 27, 1992

[87] PCT Pub. No.: WO91/11929

PCT Pub. Date: Aug. 22, 1991

[30] Foreign Application Priority Data

Feb. 16, 1990 [AU] Australia ..... PJ8684

[51] Int. Cl.[5] ..... A43B 5/00; A43B 23/28

[52] U.S. Cl. ..... 36/128; 36/134; 36/59 R; 36/67 R; 36/59 C

[58] Field of Search ..... 36/126, 128, 134, 59 R, 36/59 A, 59 B, 59 C, 67 R, 67 A, 67 D, 7.7, 7.6; D2/311, 317, 320

[56] References Cited

U.S. PATENT DOCUMENTS

| | | | |
|---|---|---|---|
| D. 275,147 | 8/1984 | Phillpott | D2/320 |
| 1,594,056 | 7/1926 | Floyd | 36/134 |
| 4,130,947 | 12/1978 | Denu | 36/59 C |
| 4,241,524 | 12/1980 | Sink | 36/59 C |
| 4,527,344 | 7/1985 | Mozena | 36/134 |
| 4,578,883 | 4/1986 | Dassler | 36/59 C |
| 4,689,901 | 9/1987 | Ihlenburg | 36/59 C |
| 4,748,752 | 6/1988 | Tanel | 36/126 |

FOREIGN PATENT DOCUMENTS

| | | | |
|---|---|---|---|
| 721701 | 3/1942 | Fed. Rep. of Germany . | |
| 882050 | 5/1953 | Fed. Rep. of Germany | 36/128 |
| 880711 | 4/1943 | France | 36/59 A |
| 120707 | 7/1918 | United Kingdom | 36/59 A |

*Primary Examiner*—Paul T. Sewell
*Assistant Examiner*—Marie D. Patterson
*Attorney, Agent, or Firm*—Watson, Cole, Grindle & Watson

[57] ABSTRACT

A shoe sole comprising a sole portion (10) with a forward toe end (12) and a rear end (13), an inner medial side (15) and an outer lateral side (16). Blade-like projections (20) extend downwardly from the sole portion (10) and are angled relative to a generally longitudinal line (31) from the toe end (12) to the rear end (13) of the sole portion (10) so that an outer end (31) of each projection nearer to the medial side (15) is located nearer to the toe end. The angled projections provide increased grip for the outside foot of a wearer during turning movement. The heights of the projections (20) progressively reduce from the rear end (13) of the sole portion towards the toe end (12). At least the forwardmost one (21) of the medial projections has an outer corner (33) at the end of the lower extremity (30) which is displaced inwardly towards the lateral side (16). A transverse flexing zone (50) extends across the sole portion (10) at the location of the ball of the foot, and a longitudinal flexing zone (19) extends along the general center line (18) of the sole portion (10) from the toe end (12) to the rear end (13). The projection (23) at the ball of the foot includes a front face (42) which is upright to assist penetration of the projection (23) into the ground and to provide grip in use, the opposite face (41) of the projection (23) being inclined so that the projection progressively thickens towards the sole portion (10).

23 Claims, 4 Drawing Sheets

SPORTS SHOE SOLE

Figure 1:
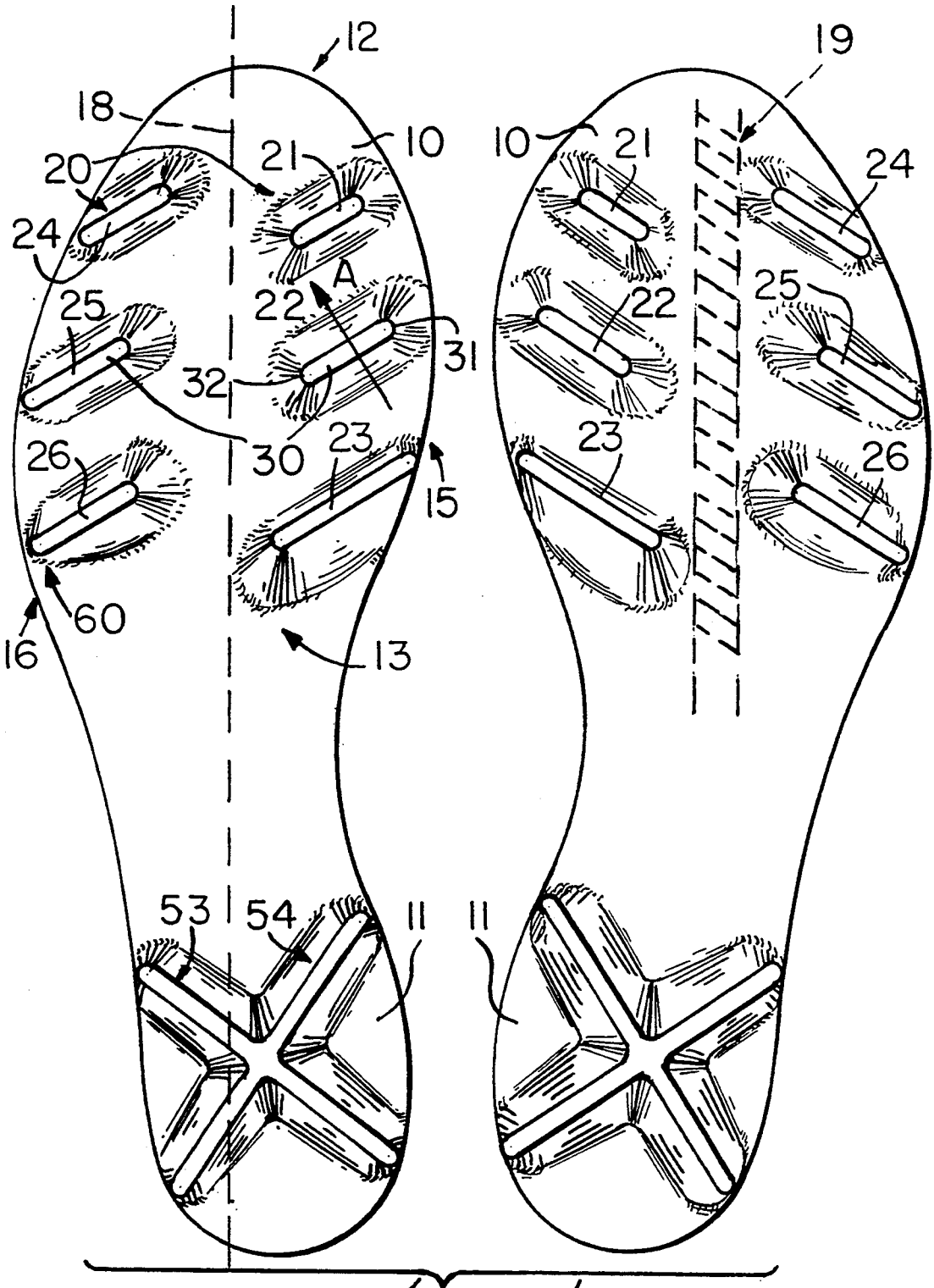

This invention relates to shoe soles, more particularly a sports shoe sole comprising a front sole portion and usually a heel portion, at least the front sole portion having projections extending downwardly from the shoe sole.

Shoes having soles of the type defined above are well known for use in sports where it is necessary to have good grip on a grass playing surface, for example all football games. One problem with shoe soles of this type is that under muddy conditions they become blocked with mud and lose their effectiveness to provide grip. The standard boot with screw-in studs often presents the wearer with turning difficulties and is known as a source of knee injury.

It is an object of the present invention to significantly reduce these disadvantages.

According to the present invention there is provided a shoe sole comprising a sole portion with a forward toe end and a rear end, an inner medial side and an outer lateral side, the shoe sole further including a plurality of blade-like projections extending downwardly from the sole portion, each projection extending downwardly to an elongated and relatively thin lower extremity, at least two of the projections being medial projections which extend from the vicinity of the medial side of the sole portion towards the lateral side and at least a further two of the projections being lateral projections which extend from the vicinity of the lateral side of the sole portion towards the medial side, at least one of the medial projections being angled relative to a generally longitudinal line from the toe end to the rear end of the sole portion so that an outer end nearer to the medial side of the sole portion is located forwardly of a centre end of the angled projection remote from the medial side of the sole portion, the angled medial projection thereby providing increased grip for the outside foot of a wearer during turning movement as a result of extending normal to or being relatively close to being normal to the direction of pushing force on the angled medial projection during such turning movement.

The expressions "inner medial side" or "inner medial edge" of the sole portion are used to refer to the side of the sole portion which is nearer to the sole portion to be worn on the other foot of the user. Thus, looking down on the right shoe being worn on the foot, the "inner medial side" and "inner medial edge" of the sole portion will be at the left side, and vice versa.

Each projection has a height defined as the distance from the sole portion to the lower extremity and the height of the projections nearer to the toe end may be less than the heights of those projections closer to the rear end. Preferably the height reduction is progressive towards the toe end. This improves the "feel" during running.

At least one of the medial projections and preferably the ones nearest the toe end, may have an outer corner at the end of the lower extremity which is nearer to the medial side of the sole portion which is displaced towards the lateral side of the sole portion and away from the line of the medial side. This enables a ball to be kicked with the inside of the foot so as to loft the ball without the medial projections striking the ball first.

There may be provided a transverse flexing zone across the sole portion at the location of the ball of the foot, the transverse flexing zone not having any projections thereon nor containing portions of any projections. This construction enables the sole portion to bend across the ball of the foot thereby enabling the foot to bend along its natural transverse flexing line.

In one possible embodiment suitable for most sports, each of the medial and lateral projections is angled obliquely across the sole portion with the end of each projection nearer to the medial side being located forwardly and closer to the toe end of the sole portion.

In an alternative possible embodiment suitable particularly for sports in which there is much forward pushing or forward acceleration, at least one of the medial projections and at least one of the lateral projections may extend transverse and normal to the general longitudinal line of the sole portion, the medial and lateral projections normal to the longitudinal line being located towards the toe end of the sole portion forwardly of the angled projections whereby forward force at the toe end of the sole portion is borne by the projections normal to the longitudinal line.

The projections are described as "blade-like" because when viewed in underneath plan, they do not appear circular like standard stops or studs, or even square, but are elongated and relatively thin. The average length of the parallel or long sides of each projection is always larger than the average width of the projection.

The advantage of these blades is that they are more easily pushed into the ground to provide grip. They also provide a large area to push against when orientated generally transverse to the direction of pushing force.

A standard stop is rounded and cuts its way through the ground offering least resistance. This is a disadvantage to the wearer since maximum grip is desirable. The blade-like projection gives far more grip than a standard round stop, when orientated so its largest cross-sectional area is generally normal to the direction of travel or of pushing force. One reason is because the cross sectional area being pushed against can be, for example about twice that of a standard stop. This characteristic is utilised in the preferred embodiment to give superior grip.

Figure 2:
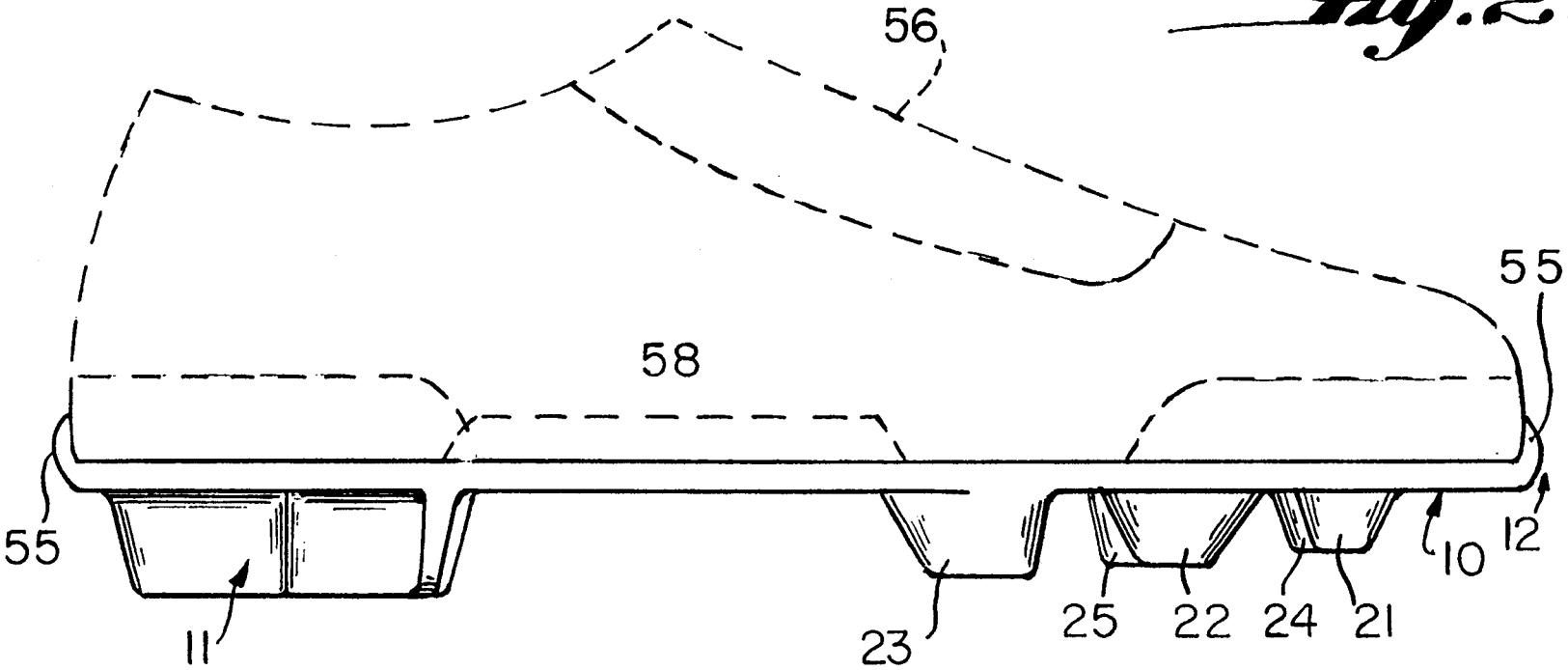
Figure 7:
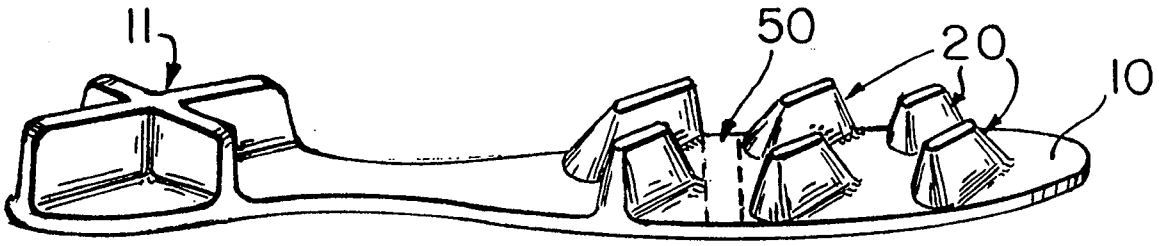
Figure 3:
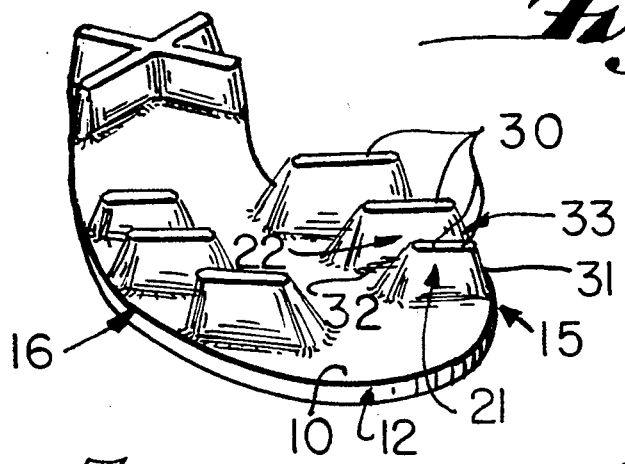
Figure 4:
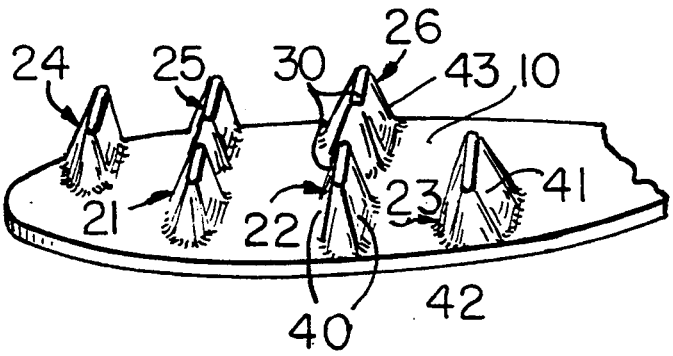
Figure 5:
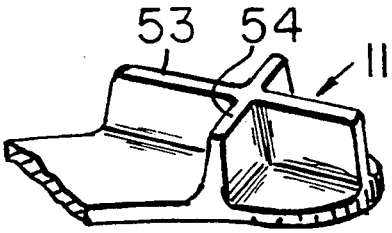
Figure 6:
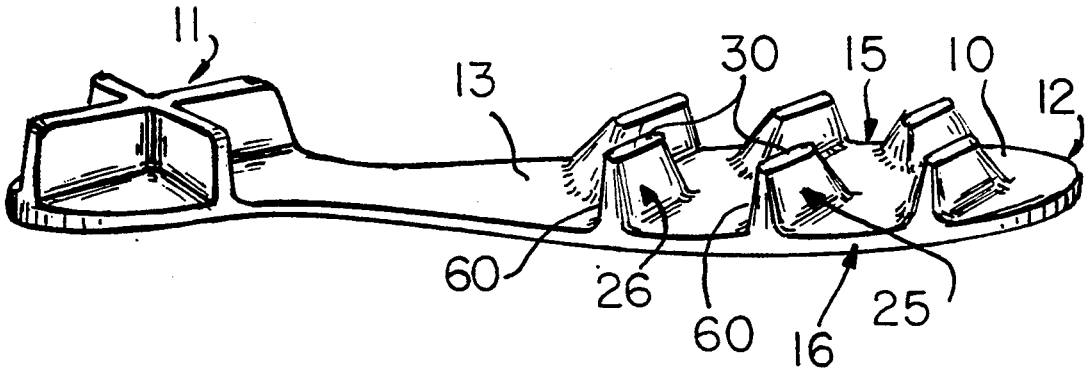
Figure 8:
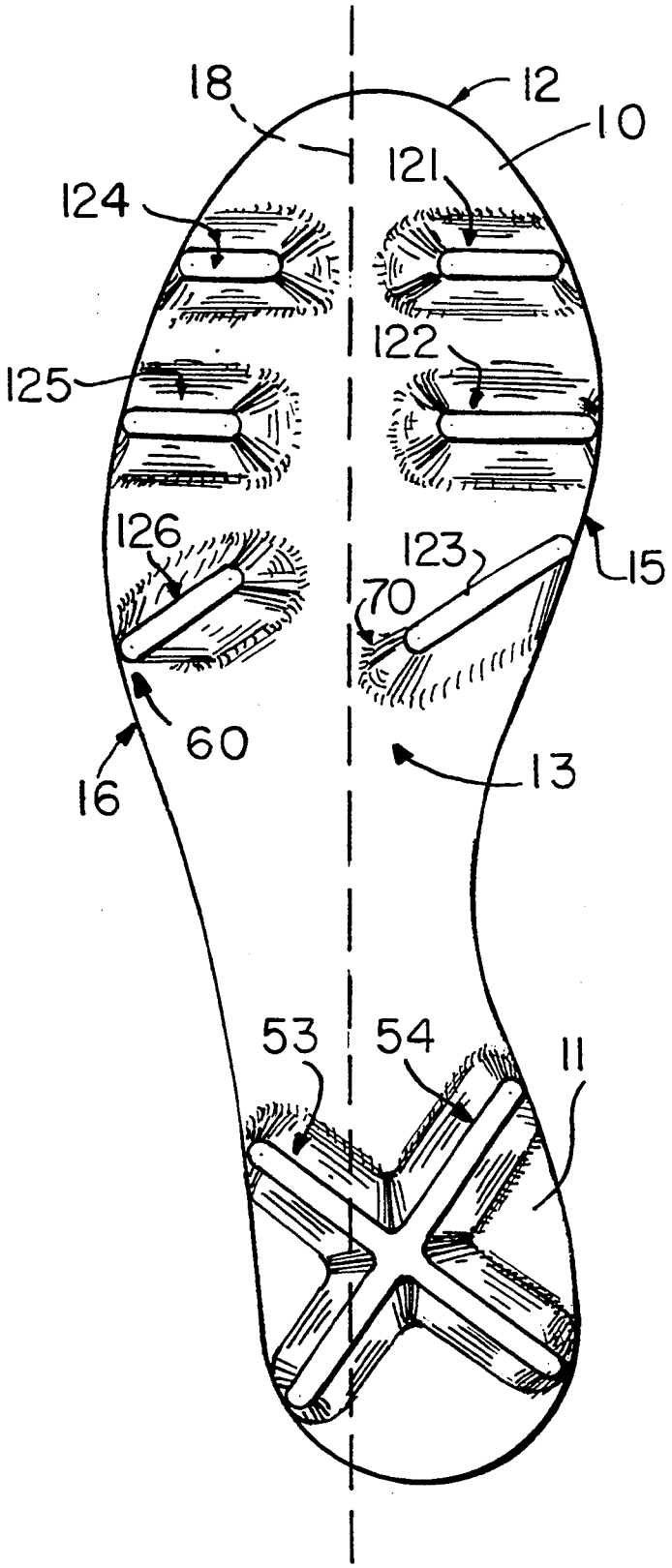

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows underneath plan views of left and right soles according to the invention, the blade-like projections being a mirror image on each shoe, FIG. 2 shows a view of the medial side of the left shoe showing how the projections gradually decrease in height as they near the toe end, FIG. 3 shows a view of the angled or chamfered blade-like projections to help with a kicking action common in soccer, FIG. 4 shows a perspective view from the medial side of the left shoe sole from near the toe end depicting the various side profiles of the blade-like projections, FIG. 5 shows the heel section on which two blade-like projections intersect to form a cross shape, the ends of the cross extend to the edges of the sole, and the projections tapering into the sole, FIG. 6 shows a view of the removed parts of the taper on two of the projections on the lateral side of the sole, so as to improve the grip of the projections during turning, FIG. 7 shows the transverse zone created by removal of some of the taper from the projection at the ball of the foot, this zone flexing of the sole across the ball of the foot, and FIG. 8 shows in underneath plan view a shoe sole according to an alternative possible embodiment.

The shoe sole in the drawings comprise a sole portion 10 with a forward toe end 12 and a rear end, an inner medial side 15 and an outer lateral side 16. The sole also includes an integral heel portion 11. A plurality of blade-like projections 20 extend downwardly from the sole portion 10. Each projection extends downwardly to an elongated and relatively thin lower extremity 30. Three of the projections 21, 22, 23 are medial projections which extend from the vicinity of the medial side 15 towards the lateral side 16. Three of the projections 20 are lateral projections 24, 25, 26 which extend from the lateral side 16 towards the medial side 15. In the embodiment of FIGS. 1 to 7, the medial projections 21, 22, 23 are angled relative to a generally longitudinal line 18 from the toe end 18 through the rear end 13 of the sole portion to the heel portion 11 so that the outer end 31 nearer to the medial side 15 is located forwardly of the centre end 32 of the angled projections remote from the medial side 15. With this feature, the angled medial projections 21, 22, 23 provide increased grip for the outside foot of a wearer during turning movement as a result of extending normal to or being relatively close to being normal to the direction of pushing force "A" on the angled medial projection during such turning movement.

The projections 20 increase in thickness as they approach the surface of the sole 10 eventually merging into the sole. The sole 10 and projections 20 are moulded in one piece so that the tapering of each protrusion 20 gives maximum strength to the protrusion and prevents a potential split line being created at the join of the sole and the projection. Rubber or a plastics material is preferred for the shoe sole.

The rate of increase in thickness of the projections 20, while being generally similar, may vary from blade to blade and even from one side to another on some projections. This variation is because the projections need to have sides as steep as possible to penetrate the ground and give grip, but they also need support so they do not bend and buckle under the pressure of running and turning.

As best illustrated in FIG. 4, most projections 20 have faces 40 which thicken towards the sole portion with a profile which is generally hyperbolic or parabolic with the maximum steepness being at or close to the lower extremity 30 so that the faces of the blades at the lower extremities are the closest to being normal to the general plane of the sole portion 40. This is true all the way along the height of the blades. The only time it is possible to deviate from this is in the top millimeter or so (near the edge coming in contact with the ground first), because by then the amount that the rubber can bend is insignificant.

The formulae describing the hyperbolae or parabolas on the blades 20 may vary from blade to blade and side to side because of the various roles they play in running and turning and the various pressures exerted on the blades. In one possible embodiment, projection 23 includes a face 42 which is substantially upright relative to the general plane of the sole portion 10 to thereby assist penetration of the projection 23 into the ground and to provide grip in use. The face 41 of the projection 23 opposite to the upright face 42 is inclined so that the projection progressively thickens towards the sole portion 10. The inclined face 41 has a generally parabolic or hyperbolic profile. The projection 23 having the one upright face 42 and the one inclined face 41 has its inclined face 41 facing towards the heel portion 11.

The blade 23 having the one upright face 42 and the opposite inclined face 41 is the projection located on the sole portion 10 generally at the ball of the foot of the wearer. This projection 23 comes under the most pressure during turning. This projection 23 is substantially thickened on the side 41 closest the heel 11 so it does not buckle. To compensate, its other side (facing the toe) is almost normal to the sole 10, to maximise the projection's penetration and grip. Each of the projections 21, 22, 24–26 have opposite faces which both taper at generally similar rates so as to define the thickening of the projections towards the sole portion 10.

The only variation to this may be on the projection 26 transversely opposite the one 23 at the ball of the foot. The heel face 43 of that projection 26 does not come into play when sprinting, so it can be tapered slower to more closely match the projection 23 at the ball of the foot.

Alternatively, in an embodiment not illustrated, the projections may slope at a generally constant angle to the general plane of the sole portion so as to define the thickening of the projections towards the sole portion. But this is inferior in design as it gives less grip as it is preferable to have as much of the blade normal to the sole as possible to give the maximum grip.

The medial projection 21 as shown in FIG. 3 has an outer corner 33 at the end of the lower extremity 30 which is nearer to the medial side 15 of the sole portion 10. The outer corner 33 is displaced towards the lateral side 16 of the sole portion and away from the line of the medial side 15. In the illustrated embodiment the medial projection 21 has an outer end 31 extending from the outer corner 33 to the sole portion 10, the outer end 31 being inclined to the general plane of the sole portion 10 so that the outer end 31 extends substantially from the medial edge 15 of the sole portion 10.

The medial projection 21 is nearest to the toe end 12 of the sole portion whereby a shoe having the sole portion 10 secured thereto can be used to strike a ball with the inside of the foot without the medial projection 21 striking the ball before the inside of the foot.

To explain this further, there is a particular kicking action in soccer that relies upon the inside of the footwear coming into contact with the ball. In particular, the foot may need to be angled to reach under the ball and impart loft. If the projection 21 at the forward end and at the inside, i.e. nearest to the major toe, extends in the medial direction to be generally immediately vertically below the inner edge 15 of the sole portion 10, the point 33 of that projection 21 at its lower extremity would contact the ground or the ball first and may limit the ability of the user to place the foot under the ball to produce the desired loft.

In the illustrated embodiment, the projection 21 nearest to the toe end 12 of the sole portion 10 and at the medial side 15 of the sole has its outer edge tapered or chamfered. The second medial projection 22 counting from the toe end 12 of the sole portion also has an outer corner displaced laterally away from the medial side 15 of the sole portion and towards the lateral side 16.

It is possible to replace the two projections 21, 22 nearest to the major toe at the medial side 15 with conventional stops, although this is not the preferred design. This is not preferred because the blade like projections have significant advantages in respect to grip, mud removal and turning that make them superior to conventional stops. This is so even though the blade like projections may be smaller in area nearer to the major toe.

As shown in FIG. 2, the heights of the projections 21, 24 nearer to the toe end 12 are less than the heights of those projections 23, 26 closer to the heel end 11. The reason for this height reduction is to improve the weight transfer during the running action. The decreasing heights towards the toe end 12 result in a smoother running action. In the preferred embodiment, the heights of the projections progressively reduce from the rear end 13 of the sole portion towards the toe end 12.

This effect of a variation in height could also be achieved by the insertion of a wedge of padding placed under the sole from heel to toe, but it is more costly and not as effective for soft grassed conditions. Use of a wedge under the heel or heel and arch does work well. In this case, the blades desirably still vary in height to get the best weight transfer effect.

Except for the problem of getting the toe part of the inside of the foot well under the ball, it is preferred that the lower extremities 30 of the blades 20 extend the full way to the inner and outer edge 15, 16 of the sole portion 10. This is to maximise the width of the sole in contact with the ground. This gives a broader base and a more stable feel to the wearer. Therefore, all the projections 23–26 not having outer corners 33 displaced laterally extend at their lower extremities 30 substantially completely to the line of the adjacent edge 15, 16 of the sole portion 10. The outer side 31 of the blade adjoining the edge of the sole portion can have some taper to make it easier to be pulled from the mould during manufacture. This can mean a slight loss of width across the sole if measuring from lower extremity of blade to lower extremity of blade but the effect should not be significant enough to be noticed by the wearer.

Having the ability to flick mud off the sole is one of the advantages of this style of boot. Aspects affecting this include the flexing of the sole which is preferably of rubber or suitable plastics material, the spacing between the projections 20 and the amount of space in the centre of the sole unoccupied by projections 20. This last feature is significant and so that the ends of the projections 20 remote from the adjacent edges 15, 16 of the sole portion 10 and closer to the general longitudinal centre line 18 are inclined relative to the general plane of the sole portion 10 thereby facilitating removal of mud from the sole portion during use.

The shoe sole 10 includes a longitudinal flexing zone 19 (see FIG. 1) extending along the general centre line 18 of the sole portion from the toe end 12 to the rear end 13. The longitudinal flexing zone 19 contains no portions of any projections 20 so that the sole portion 10 can flex along the general centre line enabling the projections on opposite sides of the longitudinal flexing zone 19 to move apart slightly during such flexing and enable mud to be dislodged from the shoe sole in use. Continuous blades extending across the sole angled on the same lines as the blades are not as effective in soft muddy conditions since too much mud sticks. To further assist longitudinal flexing, the relatively long projections 23, 26 at the ball of the foot may be split mid way along their length and substantially throughout their height.

The angles on the sides 32 facing the zone 19 need not be precise and angles between 30 and 60 degrees work satisfactorily.

In FIG. 7 a transverse flexing zone 50 extends across the sole portion 10 at the location of the ball of the foot. The zone 50 does not have any projections 20 thereon nor contains portions of any projections. This enables the sole portion 10 to bend across the ball of the foot enabling the foot to bend along its natural transverse flexing line. In most movements, the foot needs to bend across the ball of the foot. The blades 20 provide a strong resistance to bending, so if they are positioned in this zone 50, they resist bending on the natural flexing line, making the sole feel more rigid to the user and restricting performance.

In the illustrated embodiments, the heel 11 has two long blades 53, 54 that are crossed. The cross shape of the heel blades on the heel 11 provides more grip and stability than the standard studs. These blades 53, 54 are also tapered for the same reasons stated for the blade-like projections on the sole portion 10. The ends of the cross blades 53, 54 on the heel 11 extend all the way to the edge of the heel to provide the widest and most stable base to the wearer. Studs or other projections may however be used on the heel.

In FIG. 2, a lip 55 is added around the heel and/or toes so the sole can be sewn onto the upper 56. This lip 55 is angled normal to the surface of the sole and is used to wrap around the upper. Another lip 58 may extend along the lateral and/or medial side at the instep. Such lips are common on many jogging shoes. The lips facilitate a stronger bonding between upper 56 and sole 10. This lip can also broaden the sole by about 4 to 5 millimeters. The same features described still hold with the blades in this case. So, the blades, including those on the heel, still preferably extend all the way to the edges of the sole.

In the preferred embodiment, of FIGS. 1 to 7, each of the medial and lateral projections 20 is angled obliquely across the sole portion 10 with the end of each projection nearer to the medial side 15 being located forwardly and closer to the toe end 12 of the sole portion 10. The angled projections can extend at an angle between 35 and 55 degrees to the longitudinal line 18 from the toe end to the rear end. Each sole in FIG. 1 is a mirror image of the other.

With this invention, there is more grip on the outside foot during turning. This is because at least the medial projections 21–23 will be angled normal or closer to normal to the desired direction at the stress part of the turn. This provides the maximum surface area being normal to the direction of momentum of the body, for the wearer to push against and so provide the wearer with grip to perform the turn. Conversely, the other foot (which will be on the inside during the turning action) will have at this time all its blade-like projections orientated in the same direction as travel at this part of the turn (as it is a mirror image of the other foot). While still providing some grip, the inside sole provides less grip than the outside foot during the turn. The result of the variation in grip is a differential turning effect like on a racing car. The turning is then smoother and more efficient. This effect can also help in injury prevention as the wearer's weight distribution is more correct with more pressure being on the outside leg during the turn.

In the preferred illustrated embodiments, there are six blades 20 on the sole section 10 of the foot arranged to avoid the pressure points on the foot. With the six blades arranged this way, the pressure is adequately spread and substantial grip is provided.

In the preferred embodiment, the blades are in pairs transversely across the foot to balance the foot and give stable support. In one possible embodiment (FIG. 6), at least one 26 of the 10 lateral projections closer to the rear end 13 of the sole portion than the toe end 12 increases in thickness from the lower extremity 30 towards the sole portion, the increase in thickness of the projection being lesser at an outer end 60 of the projection 26 closer to the lateral edge 16 of the sole portion 10 so as to promote greater penetration of the ground by the outer end 60 of the projection at the lateral edge 16 of the sole portion during sharp turning action.

Preferably there are two such blades, being the second 25 and third 26 counting from toe 12 to heel 11. The taper may be trimmed on the outer edge 60 of the heel side of the projection. This improves penetration and grip. This may be needed as sometimes in a sharp turning action, e.g. if a player is turning right, those two projections 25, 26 on the right foot might be all that is in the ground, as the player leans over.

In a second possible embodiment shown in FIG. 8, the shoe sole 10 has two of the medial projections 121, 122 and two of the lateral projections 124, 125 extending transverse and normal to the general longitudinal line 18 of the sole portion. The medial and lateral projections 121, 122, 124, 125 normal to the longitudinal lines are located towards the toe end 12 of the sole portion forwardly of the angled projections 123, 126 whereby accelerating force at the toe end 12 of the sole portion 10 is borne by the projections 121, 122, 124, 125 normal to the longitudinal line 18. This embodiment is particularly suited to sports in which there is much forward force at the toe end of the sole, e.g. as a result of pushing in rugby scrums or in gridiron, or where rapid forward acceleration is more common and frequent than turning. The angled blades 123, 126 at the ball of the foot assist turning as in the first embodiment.

The thickness 70 of the protrusion 123 at the ball of the foot may be minimised at its inner end nearer the axis 18 while being thickened for strength towards the medial side 15. This is to minimise the amount of non bending area of the sole in this important bending zone. The protrusions will not flex as the sole flexes. This modified shape of protrusion 123 may be used instead of the shape of protrusion 23 in FIGS. 1 to 7.

It is to be understood that various alterations, modifications and/or additions may be made to the features of the possible and preferred embodiment(s) of the invention as herein described without departing from the scope of the invention as defined in the claims.

I claim:

1. A shoe sole having a forward toe end and a rear heel end, said sole divided into a half sole which includes said forward toe end, and a heel portion which includes said rear heel end, said half sole having an inner medial side and an outer lateral side wherein a longitudinal line runs along the center of said half sole and lies between said inner medial side and said outer lateral side, wherein the portion of said sole between said longitudinal line and said inner medial side defines an inner portion of said half sole and the portion of said half sole between said longitudinal line and said outer lateral side defines an outer portion of said half sole, at least a pair of elongated medial projections having a length and a width, each of said medial projections having an outer end adjacent said medial side and an opposite inner end, at least a pair of elongated lateral projections having a length and a width, each of said lateral projections having an outer end adjacent said lateral side and an opposite inner end, each of said projections extending downwardly from said sole and terminating in an elongated narrow lower edge having a length many times greater than the width thereof, the inner end of each of said projections extending downwardly from said sole and outwardly away from said longitudinal line, the outer end of each of said projections extending downwardly from the associated adjacent side and inwardly toward said longitudinal line such that the length of each of said projections tapers from a larger dimension at said sole to a smaller dimension at the lower edge thereof, the outer end of each of said lateral projections extending downwardly directly from the associated adjacent side, each of said projections having a forward surface and a rearward surface, said forward surface extending downwardly from said sole and away from said toe end, said rearward surface extending downwardly from said sole and away from said heel end such that the width of each of said projections tapers from a larger dimension at said sole to a smaller dimension at the lower edge thereof, the inner ends of each of said projections at said sole being spaced a substantial distance from said longitudinal line in a direction extending laterally of said longitudinal line and toward the associated adjacent side so that said longitudinal line is free of projections and a vacant space is provided along said longitudinal line, said medial projections being angled such that the outer ends thereof are closer to the toe end than the inner ends thereof, said lateral projections being angled such that the inner ends thereof are closer to the toe end than the outer ends thereof, the angled medial and lateral projections thereby providing increased grip for the outside foot of a wearer during turning movement.

2. A shoe sole as claimed in claim 1, wherein each projection has a height defined as the distance from the sole to the lower edge and the heights of the projections closer to the toe end are less than the heights of the projections closer to the heel end.

3. A shoe sole as claimed in claim 2, wherein the heights of the projections progressively reduce from the heel end of the sole towards the toe end.

4. A shoe sole as claimed in claim 1, wherein the outer end of at least one of the medial projections is displaced away from the medial side to define a displaced outer end.

5. A shoe sole as claimed in claim 4, wherein said medial projection having said displaced outer end has its inner end inclined to the general plane of the sole portion relative to said displaced outer end.

6. A shoe sole as claimed in claim 4, wherein the medial projection closest to the toe end is displaced from the medial side of said half sole so that a shoe having the sole secured thereto can be used to strike a ball with the inside of the foot without the medial projection closest to the toe end striking the ball before the inside of the foot.

7. A shoe sole as claimed in claim 6, wherein a second medial projection counting from the toe end is also displaced from the medial side of said half sole so that a shoe having the sole secured thereto can be used to strike a ball with the inside of the foot without the second medial projection striking the ball before the inside of the foot.

8. A shoe sole as claimed in claim 1, wherein each of said lateral projections has an outer corner at its lower edge which extends to the lateral side of said half sole.

9. A shoe sole as claimed in claim 1, wherein a transverse flexing zone is provided across the half sole at a location such that when attached to a shoe the flexing zone is provided at the ball of the foot of the wearer, said transverse flexing zone being free of projections and portions of projections thereby enabling the half sole to bend across the ball of the wearer's foot and allowing the foot to bend along its natural transverse flexing line.

10. A shoe sole as claimed in claim 9, wherein the half sole includes a longitudinal flexing zone extending along the longitudinal line from the toe end to the heel end of said sole, the longitudinal flexing zone being free of projections and portions of projections so as to enable the sole portion to flex along the longitudinal line such that projections on opposite sides of the longitudinal flexing zone are able to move slightly apart from each other during flexing thus enabling mud to be dislodged from the shoe sole in use, each of said projections of said half sole being angled along an axis wherein all of the axes of the projections of said half sole are parallel to each other.

11. A shoe sole as claimed in claim 1, wherein each of the medial and lateral projections is angled obliquely across the sole portion with the end of each projection closer to the medial side being located forwardly and closer to the toe end such that when a wearer turns so as to change to a new direction of forward motion the projections on the sole of the outer foot are elongated in the new direction of forward motion.

12. A shoe sole as claimed in claim 1, further including at least one transverse medial projection and at least one transverse lateral projection which extend transverse and substantially perpendicular to the longitudinal line, the transverse medial and transverse lateral projections being located towards the toe end and closer to the toe end than the angled projections whereby an accelerating force at the toe end of the half sole is borne by the transverse projections.

13. A shoe sole as claimed in claim 1, wherein the projections extend at an angle between 35 and 55 degrees to the longitudinal line from the toe end toward the heel end.

14. A shoe sole as claimed in claim 1, wherein each projection in elevation is generally trapezium shaped, and the lower edge of each projection is substantially parallel to the half sole.

15. A shoe sole as claimed in claim 1, wherein the half sole, the heel portion and the projections are molded in one piece and each projection increases in thickness from its lower edge toward the sole.

16. A shoe sole as claimed in claim 1, wherein at least one forward or rearward surface of at least one projection has a profile which is generally hyperbolic with the maximum steepness being adjacent the lower edge thereof.

17. A shoe sole as claimed in claim 1, wherein at least one forward or rearward surface of at least one projection has a profile which is generally parabolic with the maximum steepness being adjacent the lower edge thereof.

18. A shoe sole as claimed in claim 1, wherein one forward or rearward surface of at least one of the projections slopes at a generally constant angle relative to the general plane of the half sole.

19. A shoe sole as claimed in claim 1, wherein at least one of the projections has its forward or rearward surface situated substantially perpendicular relative to the general plane of the half sole to thereby assist penetration of the projection into the ground and to provide grip in use, and wherein the opposite surface thereof is inclined.

20. A shoe sole as claimed in claim 19, wherein the last-mentioned projection has its inclined face facing generally away from the toe end of the half sole and towards the heel end.

21. A shoe sole as claimed in claim 19, wherein the last-mentioned projection is the projection located on the half sole closest to the ball of the foot of a wearer.

22. A shoe sole as claimed in claim 21, wherein each of the projections other than the projection closest to the ball of the foot has its forward and rearward surfaces tapering at generally similar rates.

23. A shoe sole as claimed in claim 1, wherein said heel portion also has projections to engage and grip the ground.

* * * * *